US007182051B2

(12) United States Patent
Sedda et al.

(10) Patent No.: US 7,182,051 B2
(45) Date of Patent: Feb. 27, 2007

(54) ELECTROMECHANICAL VALVE ACTUATOR FOR INTERNAL COMBUSTION ENGINES AND INTERNAL COMBUSTION ENGINE EQUIPPED WITH SUCH AN ACTUATOR

(75) Inventors: Emmanuel Sedda, Sainte Honorine (FR); Christophe Fageon, Montrouge (FR); Stephane Guerin, La Gareene Colombes (FR); Jean-Paul Yonnet, Meylan (FR)

(73) Assignee: Peugeot Citroen Automobiles SA, Velizy-Villacoublay Cedex (FR)

( * ) Notice: Subject to any disclaimer, the term of this patent is extended or adjusted under 35 U.S.C. 154(b) by 0 days.

(21) Appl. No.: 10/779,900

(22) Filed: Feb. 17, 2004

(65) Prior Publication Data

US 2004/0206318 A1 Oct. 21, 2004

(30) Foreign Application Priority Data

Feb. 18, 2003 (FR) ..... 03 01953

(51) Int. Cl.
*F01L 9/04* (2006.01)

(52) U.S. Cl. ..... 123/90.11; 123/90.15; 123/90.24; 251/129.06; 251/129.07; 251/129.18; 335/229; 335/230; 335/234; 335/273

(58) Field of Classification Search ..... 123/90.11, 123/90.15, 90.24; 251/129.06, 129.07, 129.09, 251/129.15, 129.16, 129.18; 335/220, 229, 335/230, 234, 256, 258, 266, 268, 273, 281, 335/295, 302; 361/143, 146, 147; 336/110
See application file for complete search history.

(56) References Cited

U.S. PATENT DOCUMENTS

| | | | | |
|---|---|---|---|---|
| 3,858,135 | A | 12/1974 | Gray | |
| 4,533,890 | A | 8/1985 | Patel | |
| 4,715,332 | A | 12/1987 | Kreuter | |
| 5,111,779 | A * | 5/1992 | Kawamura | 123/90.11 |
| 5,775,276 | A * | 7/1998 | Yanai et al. | 123/90.11 |
| 5,797,360 | A * | 8/1998 | Pischinger et al. | 123/90.11 |
| 5,915,347 | A * | 6/1999 | Yanai et al. | 123/90.11 |
| 6,044,814 | A * | 4/2000 | Fuwa | 123/90.11 |
| 6,198,370 | B1 | 3/2001 | Schmitz | |
| 6,216,653 | B1 | 4/2001 | Okada et al. | |
| 6,269,784 | B1 * | 8/2001 | Newton | 123/90.11 |
| 6,285,151 | B1 * | 9/2001 | Wright et al. | 318/560 |
| 6,308,667 | B1 | 10/2001 | Tsai et al. | |

(Continued)

FOREIGN PATENT DOCUMENTS

DE 35 00 530 A 7/1986

(Continued)

OTHER PUBLICATIONS

French Search Report dated Nov. 4, 2003 (2 pages).

*Primary Examiner*—Thomas Denion
*Assistant Examiner*—Kyle M. Riddle
(74) *Attorney, Agent, or Firm*—RatnerPrestia

(57) ABSTRACT

An electromechanical valve actuator for internal combustion engines, equipped with a polarized electromagnet and with a magnetic plate switches between a first position close to the electromagnet and a second position remote from the electromagnet, the switching times between these positions being determined depending on the operating state of the engine. The actuator supplies the electromagnet with a variable attracting current in the course of the approach of the plate to the electromagnet.

9 Claims, 6 Drawing Sheets

U.S. PATENT DOCUMENTS

| | | | | |
|---|---|---|---|---|
| 6,334,413 | B1 * | 1/2002 | Hattori et al. | 123/90.11 |
| 6,532,919 | B2 * | 3/2003 | Curtis et al. | 123/90.11 |
| 6,542,348 | B1 * | 4/2003 | Stupak, Jr. | 361/147 |
| 6,626,146 | B1 * | 9/2003 | Yanai et al. | 123/432 |
| 6,634,327 | B2 * | 10/2003 | Yanai | 123/90.11 |

FOREIGN PATENT DOCUMENTS

| | | | |
|---|---|---|---|
| DE | 100 03 928 | A | 6/2001 |
| EP | 0 422 228 | A | 4/1991 |
| EP | 0 504 806 | A | 9/1992 |
| EP | 1 010 866 | A | 6/2000 |
| EP | 1 174 595 | A | 1/2002 |
| EP | 1 174 596 | A | 1/2002 |
| EP | 1 264 969 | A | 12/2002 |
| FR | 2 784 497 | A | 4/2000 |
| FR | 2 822 585 | A | 9/2002 |
| JP | 2001-035721 | A | 2/2001 |
| JP | 2002 130510 | A | 5/2002 |

* cited by examiner

ELECTROMECHANICAL VALVE ACTUATOR FOR INTERNAL COMBUSTION ENGINES AND INTERNAL COMBUSTION ENGINE EQUIPPED WITH SUCH AN ACTUATOR

FIELD OF THE INVENTION

The present invention pertains to an electromechanical valve actuator for internal combustion engines and to an internal combustion engine equipped with such an actuator.

BACKGROUND

An electromechanical actuator 100 (FIG. 1) of a valve 110 comprises mechanical means, such as springs 102 and 104, and electromagnetic means, such as electromagnets 106 and 108, for controlling the position of the valve 110 by means of electric signals.

The rod of the valve 110 is applied for this purpose against the rod 112 of a magnetic plate 114 located between the two electromagnets 106 and 108.

When current flows in the coil 109 of the electromagnet 108, the latter is activated and it generates a magnetic action or force, which attracts the magnetic plate 114 and maintains the latter in contact with it.

The simultaneous displacement of the rod 112 now enables the spring 102 to bring the valve 110 into the closed position, the head of the valve 110 coming against its seat 111 and preventing the exchange of gas between the interior and the exterior of the cylinder 117.

Analogously (not shown), when current flows in the coil 107 of the electromagnet 106, the electromagnet 108 being deactivated, it is activated and attracts the plate 114, which comes into contact with it and displaces the rod 112 by means of the spring 104 in such a way that the rod 112 acts on the valve 110 and brings the latter into the open position, the head of the valve being moved away from its seat 111 to permit, for example, the admission or the injection of gas into the cylinder 117.

When the electromechanical actuator 100 is functioning correctly, the valve 110 alternates between the fixed open and closed positions, the so-called switched positions, with transient displacements between these two positions. The open or closed state of a valve will hereinafter be called the "switched state."

The springs 102 and 104 form an oscillating device characterized by a switching time of the valve with the mobile elements of the actuator 100.

Given the high rigidities $k_{102}$ and $k_{104}$ of the springs 102 and 104 and the considerable mass m of the elements being displaced (plate 114, rod 112 and valve 110), the switching time is essentially a function of these rigidities $k_{102}$ and $k_{104}$ and of this mass m. Considering that the rigidities $k_{102}$ and $k_{104}$ are equal to k, the switching time $\Delta t_c$ is fixed more or less by the square root of the k/m ratio.

In other words, the switching time has low sensitivity to the variations in the current flowing in the coils 107 and 109 of the electromagnets.

The actuator 100 may also be equipped with magnets 118 (electromagnet 108) and 116 (electromagnet 106) intended to reduce the energy necessary for maintaining the plate 114 in a switched position.

Such an electromagnet 106 or 108 with a magnet will hereinafter be called a polarized electromagnet.

The presents invention results from the observation that the optimal switching time for a valve varies depending on the operation of the engine.

For example, a high switching time, using a reduced speed of switching obtained by means of springs of low rigidity, would reduce the impact noises of the plate against the electromagnet and the wear on these components in the case of an engine operating while idling. In fact, such a reduction of the noise would be particularly advantageous for the user of a vehicle while idling because the operating noise of the engine is highly perceptible when the vehicle is stopped.

Inversely, the switching time should be reduced as the speed of the engine increases.

The present invention also results from the observation that the use of a polarized actuator makes it possible to control a magnetic plate with increased sensitivity compared with a nonpolarized actuator, as was shown above [sic-Tr.Ed.] on the basis of FIG. 2.

This FIG. 2 shows the force F (ordinate 200, in N) exerted on a magnetic plate by a deactivated (curve 202) or activated (curve 204) polarized electromagnet and by a nonpolarized electromagnet (curve 206) as a function of the air gap e (abscissa 208, in mm) separating each electromagnet from the plate it controls.

It is seen that the force F exerted by the active nonpolarized electromagnet, i.e., the electromagnet supplied with a current (curve 206) decreases rapidly as a function of the air gap such that this force is relatively weak in the case of an air gap on the order of magnitude of 2 mm.

It should be recalled for this purpose that the force F exerted by a nonpolarized actuator is doubly nonlinear, namely, proportional to the second power of the intensity of the current supplying the electromagnet and inversely proportional to the second power of the air gap.

Inversely, the force exerted by this actuator decreases less rapidly as a function of the air gap in the case of an active polarized electromagnet (curve 204), so that the electromagnet still acts on the plate with an air gap on the order of magnitude of 3 mm.

It shall also be noted that the variation in the force exerted by the polarized electromagnet as a function of the air gap is more linear than the variation in the force exerted by the nonpolarized electromagnet.

Moreover, the reduction in the force exerted by the polarized electromagnet in the case of a small air gap reduces the intensity of the acceleration of the plate and consequently its velocity of impact against the plate, reducing as a consequence the noise generated by the latter.

It is also easier to control the force exerted on the plate with a polarized actuator than with a nonpolarized actuator.

Finally, it is seen that a polarized electromagnet exerts a force on a plate located in the proximity (curve 202) even though it is deactivated, whereas a nonpolarized electromagnet exerts no action in the absence of supply current.

SUMMARY OF THE INVENTION

The present invention therefore pertains to an electromechanical valve actuator for internal combustion engines, equipped with a polarized electromagnet and with a mobile magnetic plate switching between a first position close to the electromagnet and a second, remote position, the switching times between these positions being determined depending on the state of operation of the engine, characterized in that it comprises means for supplying the electromagnet with a variable attracting current in the course of the approach of the plate to the electromagnet.

Due to the present invention, the switching time of a valve is modified and adapted to the operating conditions of the engine by controlling the attracting current of the electromagnet. For example, when the engine is idling, the switching time is increased to reduce the velocity of impact of the magnetic plate and consequently the operating noise of the engine.

This mode of operation may also be used due to the increased sensitivity and the increased range of control of a polarized actuator, as was described in detail above.

In fact, this increased sensitivity and this increased range enable the electromagnet to pick up the plate at a relatively great distance and then to modify its action as the plate is approaching and the action of the magnet is developing.

In one embodiment, the actuator comprises means for reducing the attracting current as the plate is approaching, which makes it possible to reduce the consumption of the actuator.

In one embodiment, the engine comprises means for inverting the direction of the supply current of the electromagnet when the plate switches to the second position.

According to one embodiment, the actuator comprises means for controlling a current generating a magnetic field of an intensity lower than or equal to that of the magnetic field generated by a magnet of the electromagnet when the current is inverted.

In an embodiment in which the plate comes into the vicinity of a second electromagnet in its second position, the actuator comprises means for simultaneously controlling the current supplies for each electromagnet.

According to one embodiment, the actuator comprises an electromagnet equipped with an E-shaped support, a magnet being located at the end of one of the branches of the support opposite in relation to the plate.

According to one embodiment, the variations in the current are relative to an amplitude and/or to a supply time.

In one embodiment, the actuator comprises means for considering the engine speed to be a parameter of the operating state of this engine.

Thus, the present invention pertains to an internal combustion engine equipped with an actuator comprising a polarized electromagnet and a magnetic plate switching between a first position close to the electromagnet and a second position. Such an engine is characterized in that the actuator is according to one of the above-described embodiments.

BRIEF DESCRIPTION OF THE DRAWINGS

Other characteristics and advantages of the present invention will become apparent from the following description of an embodiment of the present invention, which is given as a nonlimiting example, with reference to the figures attached, in which:

FIG. 3*a* shows the position x (ordinate 300, in mm) of a magnetic plate located between an upper electromagnet and a lower electromagnet with magnets. The position x=0 corresponds to the equidistant position of the plate opposite the two electromagnets.

DETAILED DESCRIPTION

This position is shown as a function of the time t (abscissa 302, in msec) measured starting from a switching command (t=0).

Figure 1:
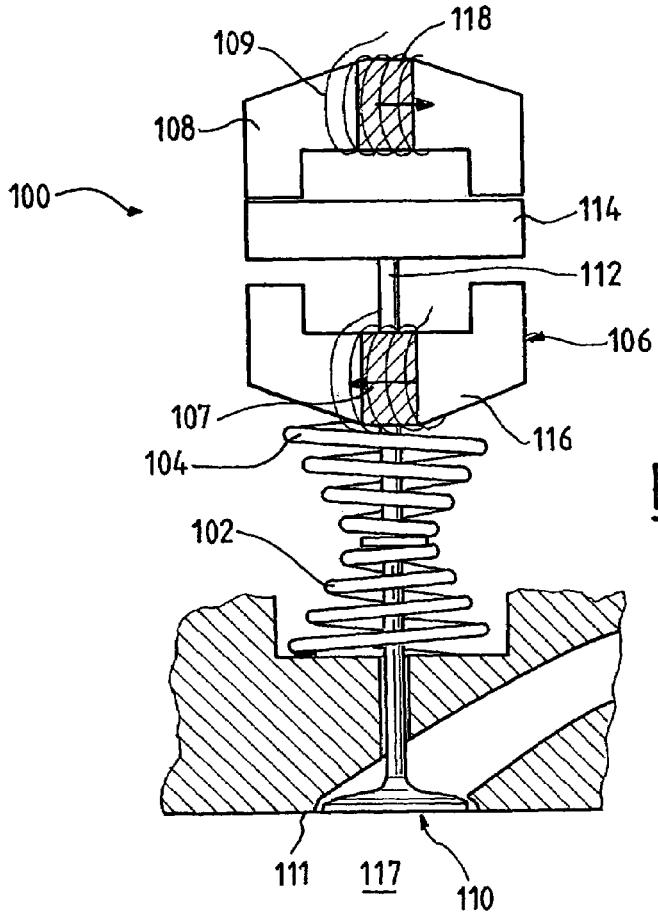
FIG. 1, already described, shows a prior-art polarized actuator.
Figure 2:
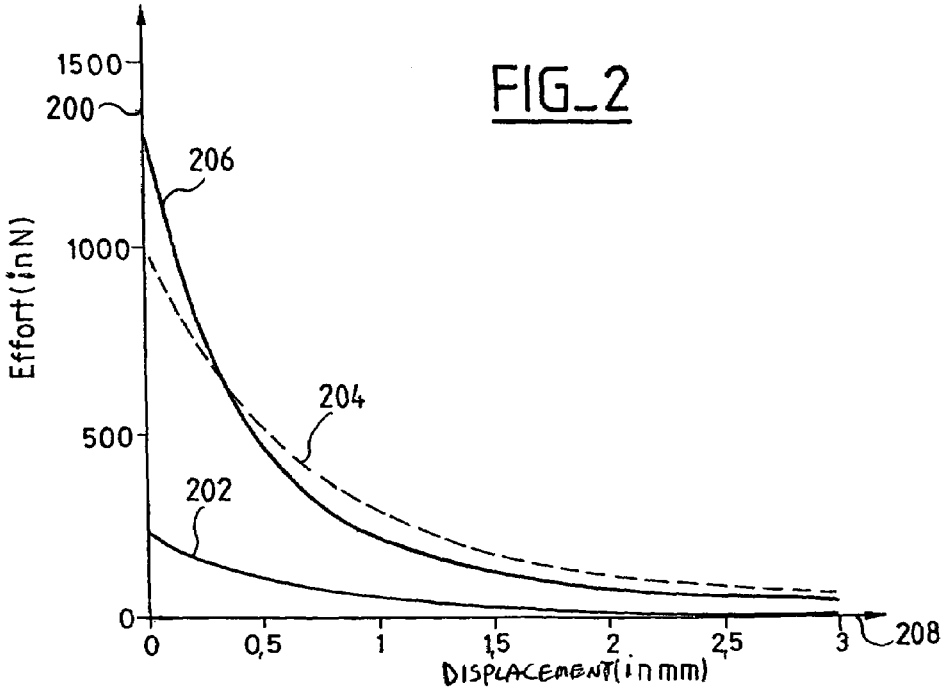
FIG. 2, already described, shows the actions exerted by the electromagnets on a plate as a function of the air gap existing between this plate and the electromagnets.
Figure 3A:
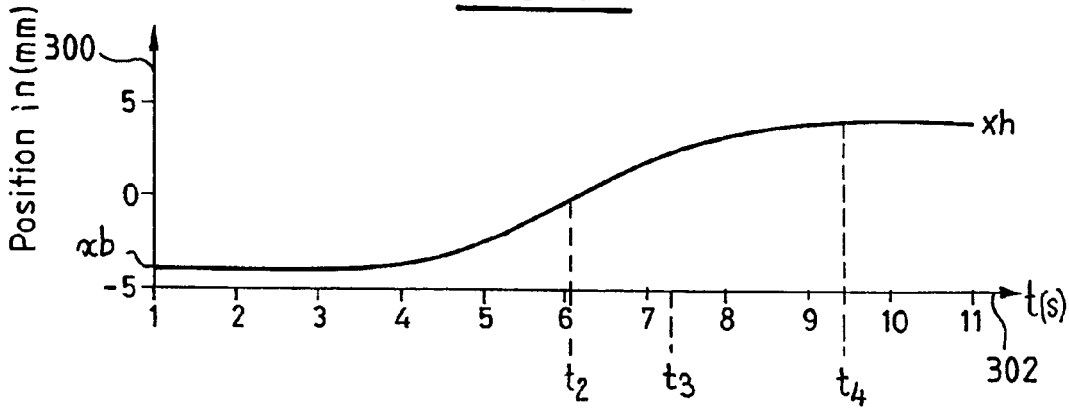
FIGS. 3*a*, 3*b*, 3*c*, 4*a*, 4*b*, 4*c* show valve switching measures following a first switching time of an actuator according to the present invention.
Figure 3B:
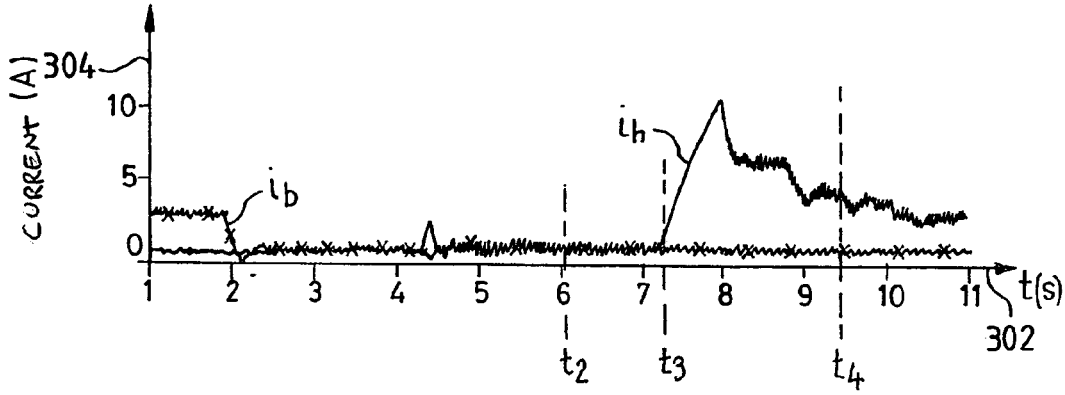
Figure 3C:
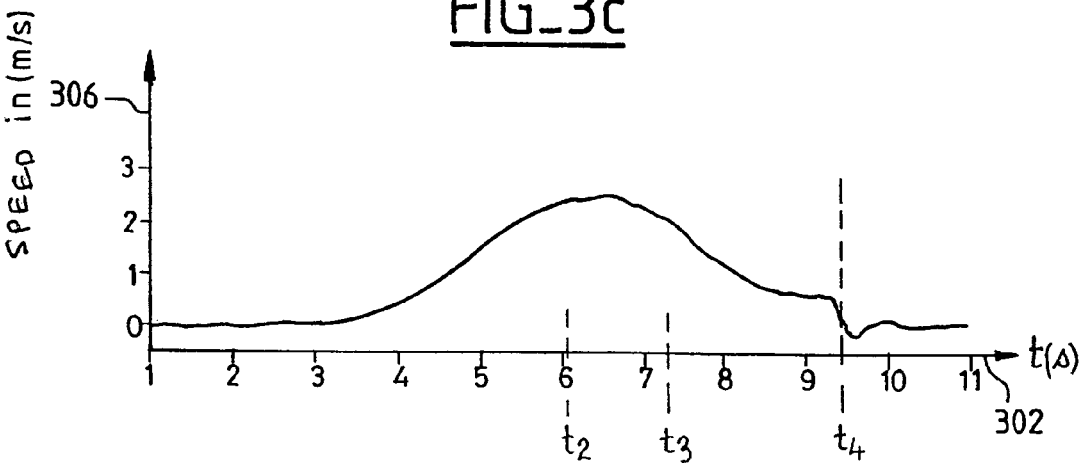

FIG. 3*b* shows the respective currents $i_b$ and $i_h$ (ordinate 304, in A) with which the lower electromagnet and the upper electromagnet of the actuator being considered is supplied, whereas FIG. 3*c* shows the velocity v (ordinate 306, in m/sec) of the magnetic plate.

It is seen that the switching from a lower position $x_b$ (FIG. 4*a*) to an upper position $x_h$ of the plate, corresponding to an opening of the valve, requires a variation in the currents $i_b$ and $i_h$.

In fact, the plate is maintained in its lower position at first by means of a holding current $i_b$ with a value on the order of magnitude of 3.5 A.

Then, the displacement of the plate toward its upper position is achieved by annulling this current $i_b$ (moment $t_1$), the plate being displaced now toward its upper position under the effect of springs of the electromechanical actuator (increasing x).

During its passage through the equidistant position between the two electromagnets (x=0, moment $t_2$), the velocity v of the plate is close to its maximum and then it decreases as the plate is approaching the upper electromagnet.

When the plate is close to the upper electromagnet (moment $t_3$), the upper electromagnet is supplied with an increasing current $i_h$ so as to attract the plate and to maintain it stabilized in contact with the upper electromagnet.

When the switching of the valve is achieved ($x=x_h$, v=0, moment $t_4$), the plate is maintained against the upper electromagnet by a current $i_h$ of the same intensity as that of the current $i_b$ holding the plate against the lower electromagnet.

However, according to other variants, the value of the holding current used in the upper electromagnet may be different from the value of the holding current used in the lower electromagnet, especially when the electromagnets are distinct.

According to another variant, the two holding currents are zero, so that no power consumption is required for holding a valve.

Figure 4A:
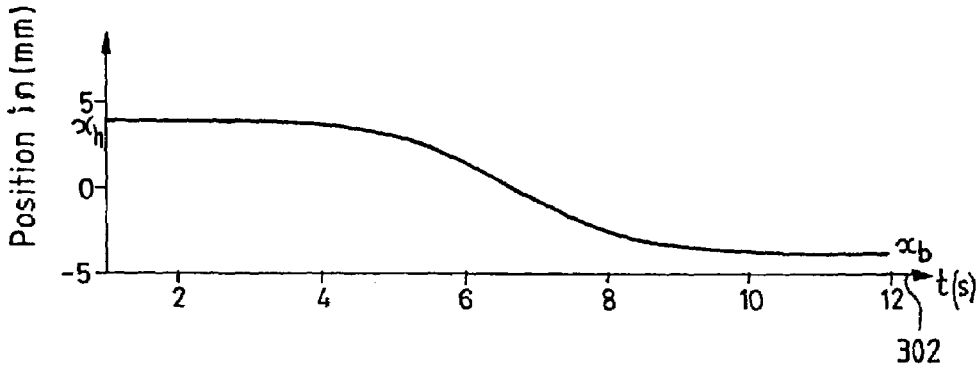
Figure 4B:
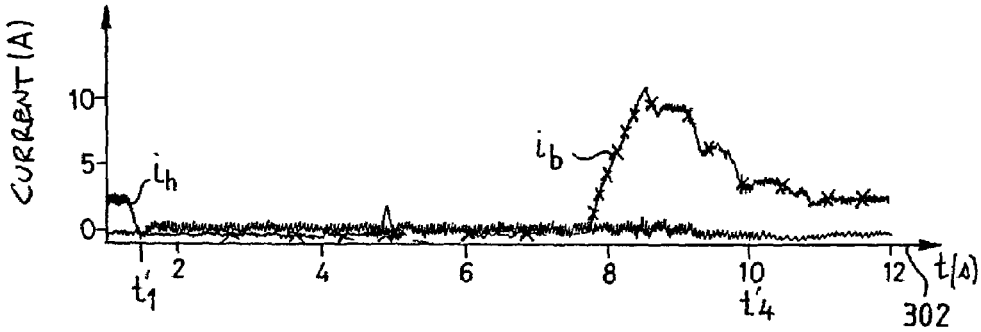
Figure 4C:
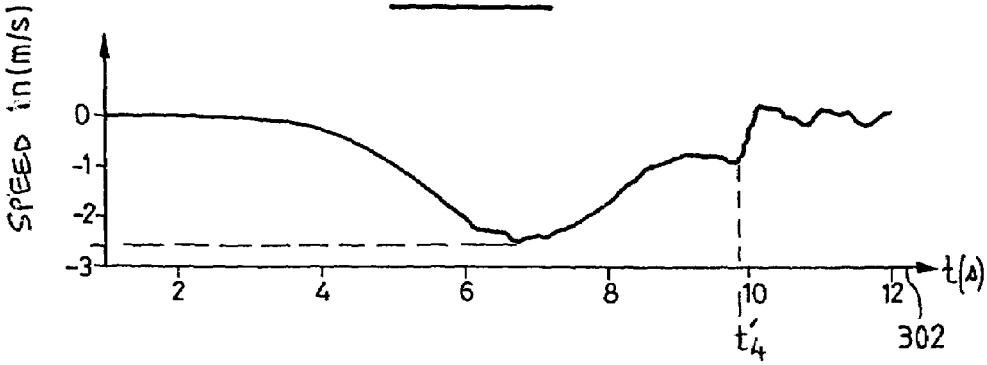

FIGS. 4*a*, 4*b* and 4*c* show the passage from an upper position into a lower position of the plate following switching times on the same order of magnitude as described previously, it being given that the plate performs an inverse switching.

It should be pointed out that the switching times vary as a function of the dimensioning of the actuator and especially the masses being displaced and the rigidity of the springs.

Such an increase in the switching time may also be increased by using springs of low rigidity, for example, when the mass of the plate is also limited.

In fact, the use of springs of low rigidity limits the intensity of the force exerted by these springs on the plate, reducing as a consequence the velocity of displacement of the plate and the switching time.

The switchings of the valve according to a long time, such as those shown in FIGS. 3*a*, 3*b*, 3*c*, 4*a*, 4*b* and 4*c*, will hereinafter be called slowed switchings.

Figure 5A:
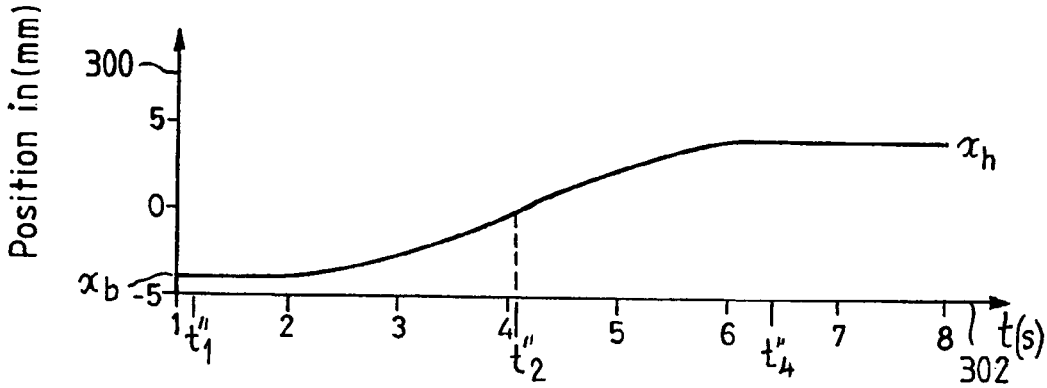
FIGS. 5*a*, 5*b*, 5*c*, 6*a*, 6*b*, 6*c* show valve switching measures following a second switching time of the actuator according to the present invention.
Figure 5B:
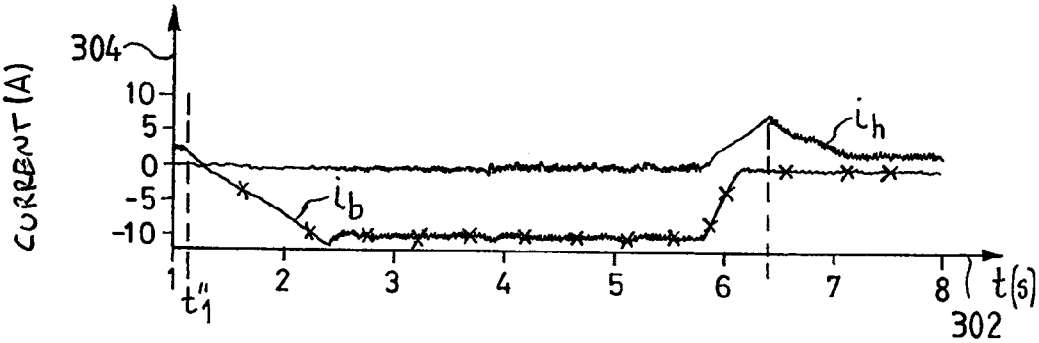
Figure 5C:
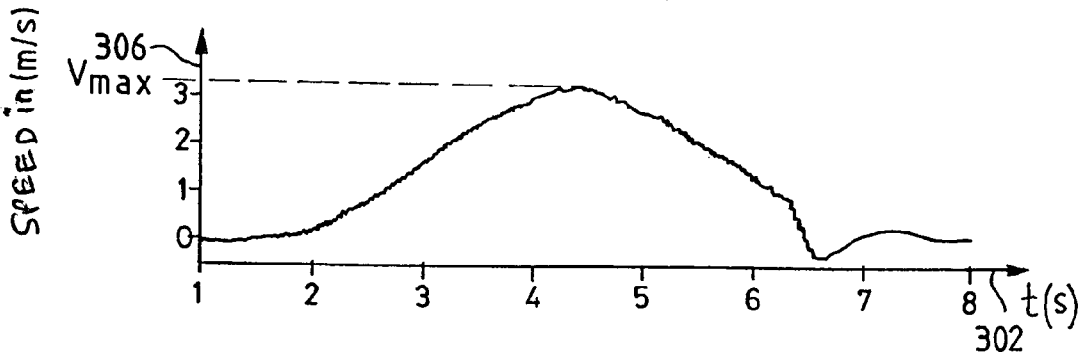

FIG. 5*a* shows position x of the plate controlling the valve, which figure was previously used to describe a slowed-down switching. However, this valve is controlled in FIG. 5*a* following an accelerated switching, the switching time being reduced compared with the long time used previously.

When the plate is switched from a lower position into an upper position, the current $i_b$ (FIG. 6*b*) flowing in the lower coil is inverted for this (moment $t''_1$) and increased to demagnetize the magnet to accelerate the separation of the plate from the lower electromagnet, partially or completely annulling the force exerted by this magnet on the plate.

In other words, by generating a magnetic field that is inverse to the field of the magnet, it is possible to reduce and annul the attraction exerted by the electromagnet on the plate.

This action enables the plate to reach a higher velocity of switching compared with the slowed switching described on the basis of FIGS. 3*a*, 3*b* and 3*c* more rapidly.

Figure 6A:
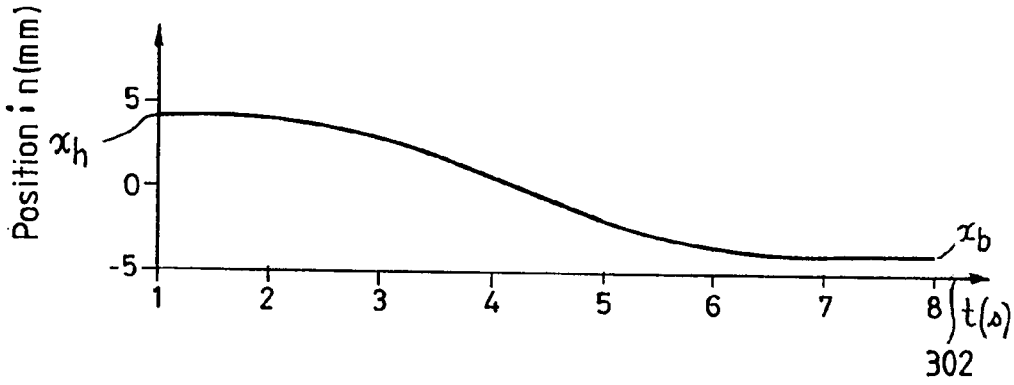
Figure 6B:
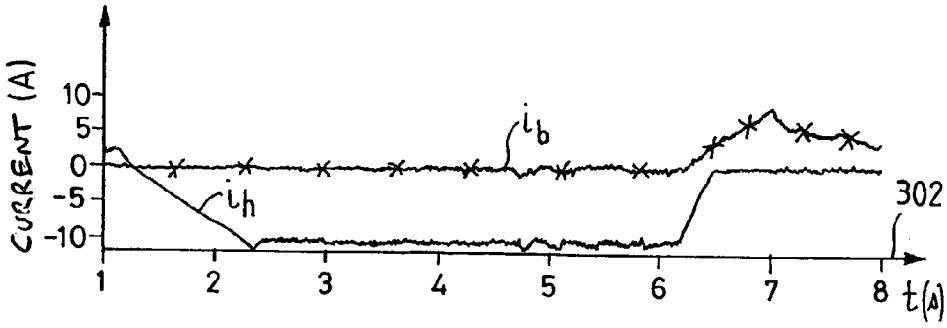
Figure 6C:
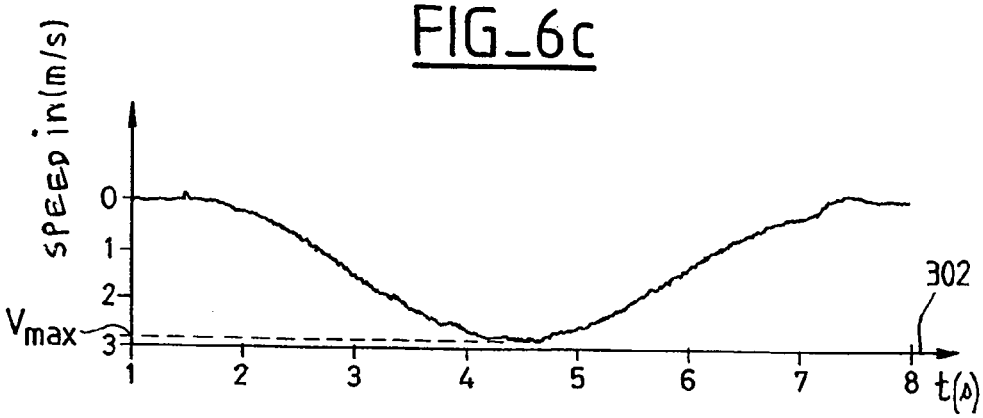

FIGS. 6*a*, 6*b* and 6*c* show an accelerated switching from an upper position into a lower position.

Thus, to displace the plate from an upper position $x_h$ into a lower position $x_b$, as is shown in FIG. 6*a*, the direction of the current $i_h$ flowing in the upper electromagnet is inverted (FIG. 6*b*) so as to demagnetize the magnet and to accelerate the separation of the plate from the upper electromagnet.

In fact, the maximum velocity reached by the plate ($v_{max}$, FIG. 6*c*) is higher than in the equivalent situation described in FIG. 4*c*.

It should be pointed out that depending on the desired switching time, the inverted magnetic field generated by the electromagnet is of a defined intensity and duration.

In fact, the higher the intensity of this field, the weaker is the magnetic field of the magnet.

As was mentioned above, the lower the rigidity of the springs, the greater can be the variations in the switching time.

It should also be pointed out that the variations in the switching time may be obtained by modifying one or more parameters, such as the amplitude or the application times of the supply current of a coil.

Figure 7:
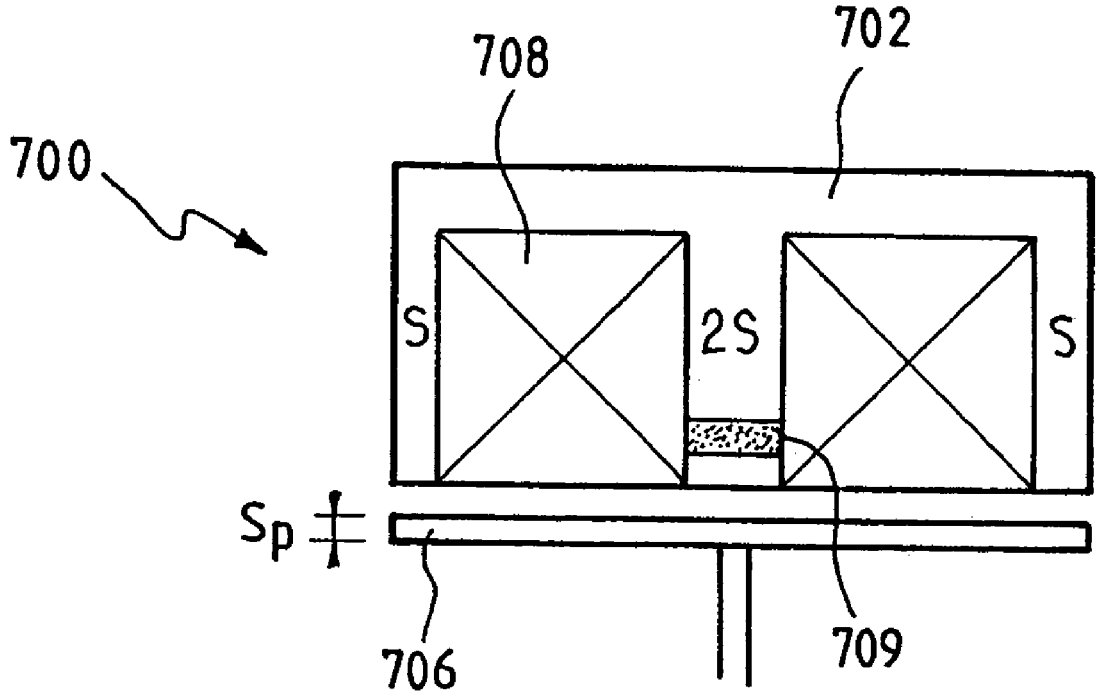
FIG. 7 shows the electromagnet used to perform the measures according to FIGS. 3*a*, 3*b*, 3*c*, 4*a*, 4*b*, 4*c*, 5*a*, 5*b*, 5*c*, 6*a*, 6*b* and 6*c*.

An electromagnet 700 (FIG. 7) whose E-shaped support 702 is equipped with a magnet 709 at the end of one of its branches, the central branch in this example, may be used for this.

As the magnet 709 is located opposite in relation to the plate 706 it controls, the leakage is reduced and the action of the magnet on the plate 706 is increased.

The field of the magnet, on the order of magnitude of 1.2 Tesla for a neodymium-iron-boron magnet, is also weaker than the field necessary for saturating the plate 706 formed by a ferromagnetic material.

Consequently, it is possible to use a plate with a cross section $S_p$ that is smaller than the cross section S of the magnetic circuit formed by the branches of the support 702, until the saturation limit of the plate is reached.

A reduction of the cross section of the plate by a factor of 1.6 is now achieved in this example, which makes it possible to reduce the mass of the plate and consequently the rigidity of the springs, thus increasing the control exerted on the mobility of the plate by the current circulating in the coil 708 of the electromagnet.

The present invention may have numerous variants. Thus, if the plate is located between two electromagnets, these two electromagnets may comprise means for modifying the switching time of the plate as was previously described.

What is claimed is:

1. A method of displacing a mobile magnetic plate of an electromechanical valve actuator for internal combustion engines from a second position to a first position, said electromechanical valve actuator comprising:

a first polarized electromagnet and a second polarized electromagnet, each polarized electromagnet including a magnet, a mobile magnetic plate positioned between the electromagnets and configured for switching between a first position close to the first electromagnet and a second position close to the second electromagnet, the switching times between these first position and the second positions being determined depending on the operating state of the engine, said method of displacing the mobile magnetic plate from the second position to the first position comprising the steps of:

supplying the first electromagnet with a variable attracting current, wherein the variable attracting current increases progressively to a peak value in the course of the approach of the plate to the first electromagnet, and the variable attracting current is immediately decreased after the peak value is achieved, and is decreasing when the magnetic plate contacts the first electromagnet, and supplying the second electromagnet with a second current generating a magnetic field opposite to the magnetic field of the magnet of the second electromagnet in order to temporarily demagnetize the magnet of the second electromagnet, the second current being of an intensity lower than or equal to the intensity of the magnetic field generated by the magnet of the second electromagnet, wherein the second current is generated at least until the mobile magnetic plate has traveled about one-half of the distance separating the first electromagnet from the second electromagnet.

2. The method of claim 1, further comprising a step of reducing the first attracting current as the plate is approaching the first electromagnet.

3. The method of claim 1 or 2, further comprising a step of inverting the direction of the current supplying the first electromagnet when the plate switches to the second position.

4. The method of claim 3, further comprising a step of controlling a current that is generating a magnetic field of an intensity lower than or equal to the intensity of the magnetic field generated by the magnet of the first electromagnet when the current is inverted.

5. The method of claim 1 or 2, wherein the mobile magnetic plate moves into the vicinity of the second electromagnet in its second position and the method further comprises a step of simultaneously controlling the current supplies for the first electromagnet and the second electromagnet.

6. The method of claim 1 or 2, wherein each electromagnet is equipped with an E-shaped support having three branches, and the magnet of each electromagnet is located at the end of one of the branches of the support opposite in relation to the mobile magnetic plate.

7. The method of claim 1 or 2, wherein variations in the currents are related to one of an amplitude and a duration of supply of the currents.

8. The method of claim 1 or 2, further comprising a step of adjusting the variable attracting current responsive to the speed of the engine to be a parameter of the operating state of the engine.

9. Internal combustion engine equipped with an actuator comprising a polarized electromagnet and a magnetic plate switching between a first position close to the electromagnet and a second position, characterized in that the actuator is configured to operate according to the method of claim 1 or 2.

* * * * *